US006525491B2

(12) United States Patent
Huber et al.

(10) Patent No.: US 6,525,491 B2
(45) Date of Patent: Feb. 25, 2003

(54) STABILIZING THE OPERATION OF GAS DISCHARGED LAMPS

(75) Inventors: Andreas Huber, Maisach (DE); Josef Osterried, Ottobrunn (DE); Alwin Veser, Hallbergmoos (DE); Wolfram Graser, Munich (DE)

(73) Assignee: Patent-Treuhand-Gesellschaft fuer Elektrische Gluehlampen, Munich (DE)

( * ) Notice: Subject to any disclaimer, the term of this patent is extended or adjusted under 35 U.S.C. 154(b) by 5 days.

(21) Appl. No.: 09/829,052

(22) Filed: Apr. 10, 2001

(65) Prior Publication Data

US 2001/0030515 A1 Oct. 18, 2001

(30) Foreign Application Priority Data

Apr. 14, 2000 (DE) ..... 100 18 860

(51) Int. Cl.[7] ..... G05F 1/00
(52) U.S. Cl. ..... 315/291; 315/307; 315/82
(58) Field of Search ..... 315/91, 82, 307, 315/224, 291, DIG. 7, 246, 209 R

(56) References Cited

U.S. PATENT DOCUMENTS

| | | | | | |
|---|---|---|---|---|---|
| 4,485,434 | A | | 11/1984 | Beeston et al. | 363/132 |
| 5,198,728 | A | * | 3/1993 | Bernitz et al. | 315/291 |
| 5,739,644 | A | * | 4/1998 | Bernitz et al. | 315/209 R |
| 6,005,356 | A | * | 12/1999 | Horiuchi et al. | 345/7 |
| 6,163,115 | A | * | 12/2000 | Ishizuka | 315/224 |
| 6,215,252 | B1 | * | 4/2001 | Stanton | 315/224 |
| 6,239,556 | B1 | * | 5/2001 | Derra et al. | 315/209 R |
| 6,281,642 | B1 | * | 8/2001 | Konishi et al. | 315/307 |
| 6,369,526 | B1 | * | 4/2002 | Pogadaev et al. | 315/224 |
| 6,392,362 | B1 | * | 5/2002 | Ito | 315/224 |

FOREIGN PATENT DOCUMENTS

WO 95/35645 12/1995

* cited by examiner

*Primary Examiner*—Don Wong
*Assistant Examiner*—Ephrem Alemu
(74) *Attorney, Agent, or Firm*—Carlo S. Bessone

(57) ABSTRACT

Flickering phenomena in gas discharge lamps are undesired in projection technology, in particular. According to the invention, the problem is solved by setting a lamp operation which does not form a focal spot. A specific control structure which includes a cascade structure and feedforward control is proposed for implementing this operation.

9 Claims, 3 Drawing Sheets

STABILIZING THE OPERATION OF GAS DISCHARGED LAMPS

TECHNICAL FIELD

The invention relates to a method for operating gas discharge lamps. Moreover, the invention relates to a ballast for operating gas discharge lamps.

PRIOR ART

During operation of a gas discharge lamp (also termed lamp below), the type of rooting of the discharge on the electrode depends on whether the electrode emits electrons (cathode) or captures them (anode). In the case of the anode, the discharge is rooted in a fashion distributed over a large area of the electrode, while in the case of the cathode a so-called focal spot (hot spot) is formed as a rule, as a result of which the discharge is rooted, rather, in a punctiform fashion. The point at which the focal spot is rooted depends on the electrode geometry, the electrode material and the temperature distribution on the electrode. These parameters are subject to changes during operation, such that the root point of the focal spot can change its position, and this is expressed by instability of the gas discharge (arc instability) or flickering. This flickering occurs, in particular, in the case of operation of the lamp with alternating current, since an electrode alternately forms a cathode and anode, and therefore the focal spot must reform with each change of the anode to the cathode.

So-called square-wave operation of the lamp is known, for example from U.S. Pat. No. 4,485,434, for the purpose of reducing flickering. It has emerged that it is advantageous to select a square-wave lamp current instead of a sinusoidal one for the stability of the AC operation of high-pressure gas discharge lamps. Customary values for the frequencies of the square wave are from 50 Hz to 200 Hz. Square-wave operation has become established in the case, in particular, of applications in image-recording and projection technology, where the constancy of the luminous flux is important. Commutation which is as fast as possible is aimed at in order for the time interval in which the luminous flux does not correspond to the square-wave amplitude to be as short as possible.

Despite the square-wave operation, the stability of the discharge is not yet satisfactory, in particular, in the case of short-arc high-pressure discharge lamps, which are preferred for use in projection technology. In order to improve the arc instability, PCT Application WO 95/35645 proposes a pulse-shaped rise in the lamp current at the end of a square wave period. The current rise is attended by a temperature rise which exerts a stabilizing influence on the position of the focal spot. Only approximate data are given on the duration and height of the pulses and on the operating frequency. Again, the mode or operation of the method is only indicated. Thus, the application of the method to a lamp of different design (for example with a different electrode geometry or different filling pressure) than the lamp addressed in the exemplary embodiment is possible only after extensive experimental work.

However, it is not only a problem to fix a suitable shape of the current curve but, as is set forth below, it is also a problem to produce a desired shape of curve. The load circuit of an arrangement for operating a discharge lamp includes, inter alia, energy stores which can also be parasitic, and the lamp, which constitutes a non-linear load.

The network of energy stores forms resonant frequencies which can be excited by the nonlinear load. Particularly in the case of the operation of short-arc high-pressure lamps, this leads to long-lasting transient phenomena after the commutation of the lamp current in the square-wave operation. These oscillations are also to be observed in the luminous flux, of course. In the case of applications which require high constancy of the luminous flux (e.g. video projection), it is therefore necessary to ensure that the time interval in which transient phenomena occur is short by comparison with the period of the square wave. The controller used in the relevant operating unit has a substantial influence on the duration of the transient phenomenon. A variable which constitutes a measure of the lamp power and is compared with a reference measure is produced in conventional operating units for the said applications. The result of this comparison supplies the manipulated variable for the power section of the operating unit. The settling time for a light source with square-wave operation can be defined by the time which elapses from the commutation up to the instant at which the luminous flux has adjusted itself in a band of +/−5% about the setpoint. For the abovedescribed, conventional controller, this settling time is 250 $\mu$s–300 $\mu$s. Since the settling time should be at most 10% of a half period of the square wave, it follows that frequencies of at most 200 Hz can be realized for the square wave with conventional controllers.

SUMMARY OF THE INVENTION

According to the discussion on the prior art, the object of the present invention falls into two parts: firstly, the invention is intended to provide a method which permits virtually flicker-free operation of a gas discharge lamp with clearly defined parameters. Secondly, the invention is to provide means with the aid of which the above method can be implemented.

Secondly, in accordance with the preamble of claim 6 the invention is to provide means with the aid of which the above method can be implemented.

The first part of the object is achieved by means of a method having the characterizing features of claim 1. Particularly advantageous refinements are to be found in claims 2 to 5, which are dependent on claim 1.

As explained in the discussion on the prior art, the cause of the flickering of a lamp is based on the fact that the focal spot, which constitutes the root of the gas discharge on the cathode, changes its position continuously. A more precise analysis shows that no focal spot is formed directly after an electrode commutates to the cathode. Rather, what is firstly found is an area-wide discharge root. Only after a thermal inhomogeneity has been produced on the cathode does the discharge become constricted and form a focal spot. According to the invention, flickering of the lamp can be greatly reduced by carrying out commutation of the lamp current before the discharge forms a focal spot. Current edges which are steep with respect to time are required for an electrode to change as quickly as possible from cathode to anode, for which reason the method can be very effectively implemented by a square-wave current characteristic. Since a flicker-free operation is important, in particular, for applications in projection technology, the method is particularly important for lamps which are used in the case of such applications. These are chiefly high-pressure and extra-high-pressure discharge lamps and, because of the optical imaging qualities, particularly those having short discharge arcs. The frequency of the square-wave lamp current must be at least 300 Hz for such lamps, in order to satisfy the teaching of the method according to the invention.

If the method is applied for the first time to a specimen lamp, or if the lamp has mean time been operated using a different method, it is possible despite the application of the method according to the invention for flickering phenomena to occur for a short time after the lamp is taken into operation. The reason for this is an electrode structure which favors a quick formation of focal spots at different positions. The application of the method according to the invention, however, shapes the electrodes in such a way as to exert a stabilizing influence on the discharge arc. This produces a virtually flicker-free operation after a short time by means of the method according to the invention.

As described above, implementing the method according to the invention in the case of extra-high-pressure short-arc lamps requires a frequency of at least 300 Hz for the square-wave lamp current, while a frequency of at most 200 Hz can be implemented with operating units which include a conventional controller structure. The second part of the task of the present invention is to close this gap.

It is usual in an operating unit for gas discharge lamps to generate an output voltage UA from a constant, so-called intermediate circuit voltage U0 with the aid of a clocked DC/DC converter. Said output voltage is a DC voltage which can be set by a manipulated variable Us. The DC/DC converter can be of various types, such as, for example, step-up, step-down or inverse converters. With these converters, the manipulated variable Us varies the pulse duty factor of the circuit breakers included in the converters. The square-wave operation of the lamp is mostly implemented by virtue of the fact that the output voltage UA has its polarity reversed by means of a full bridge circuit with the desired frequency for the square wave.

The controlled variable of the operating unit is the power of the lamp (Pist). In cases where the lamp power can be determined only expensively, and the power loss of the operating unit is sufficiently accurately known, the input power of the DC/DC converter can also be used as a controlled variable. In conventional operating units, Pist is compared with a setpoint Psoll, and the manipulated variable Us is determined therefrom, without the assistance of further measured variables, directly or after weighting by a control characteristic proportional (P), proportional integral (PI), integral (I), proportional integral differential (PID)) However, no short settling time after commutation of the lamp current is possible by means of this structure.

According to the invention, the problem is solved by means of two measures: cascade control and feedforward control. Cascade control, as also applied in principle in the case of the so-called Current Mode in switched-mode power supplies, is implemented in the operating unit according to the invention by virtue of the fact that the weighted control difference from Pist and Psoll does not fix the value of the manipulated variable Us, but defines a setpoint for the lamp current Isoll. Isoll is compared with the value Iist, which constitutes a measure for the lamp current, and it is this result of comparison which first fixes the manipulated variable Us directly or after weighting by a control characteristic (P, PI, PID). The feedforward control is implemented as follows in the operating unit according to the invention: the output voltage UA, which is to be measured at the lamp terminals, is also a determining factor for the lamp power. Auxiliary circuits (for example ignition circuits) and supply means can lead to fluctuations in the output voltage UA. Fluctuations in UA interfere in the control process particularly in the case of the transient reaction after commutation of the lamp current. Consequently, according to the invention Isoll is determined not only by the control difference of Pist and Psoll, but is also brought into dependence on the output voltage UA. This can also be performed by means of weighting with a control characteristic, it being preferred to select a differentiating characteristic in order to accentuate the fluctuations in UA.

The invention is illustrated with the aid of the following figures.

DESCRIPTION OF THE DRAWINGS

A preferred embodiment of the controller structure according to the invention, and the results which can be achieved therewith during operation of a gas discharge lamp are explained in more detail below with reference to the attached drawings, in which:

FIG. 1 shows the discharge of a short-arc high-pressure lamp directly before commutation of the lamp current. The focal spot formed is to be seen. Such a discharge does not correspond to the teaching of the present invention, and therefore tends to produce flickering phenomena.

FIG. 2 also shows the discharge of a short-arc high-pressure lamp immediately before commutation of the lamp current. However, the frequency of the square-wave lamp current is now so high that no focal spot is formed. This corresponds to the teaching of the present invention, for which reason this discharge exhibits only negligible flickering phenomena.

FIG. 3 shows a block diagram of a controller structure according to the invention. Since the aim is to control the lamp power in a primary control loop, the first step is to form the control difference from Pist and Psoll at a first subtraction point S1 and weight it with the aid of a control characteristic RC1. The control characteristic RC1 can be a P, PI, I or PID characteristic. The weighted signal is fed to a second subtraction point S2. The output voltage UA weighted with the aid of the control characteristic RC2 is subtracted. The control characteristic RC2 is expressed in FIG. 3 in a preferred differential characteristic (DT1), but it can also fundamentally have a different characteristic (for example P, PI, I, or PID). The feedforward control mentioned in the description section is implemented at the second subtraction point S2.

The output of the second subtraction point S2 constitutes the setpoint Isoll of the inner control loop of the cascade control mentioned in the description section. Isoll is compared at a third subtraction point S3 with a variable which corresponds to the value of the lamp current. The result of this comparison becomes the manipulated variable Us after weighting with a control characteristic RC3. The control characteristic RC3 can be a P, PI, or PID characteristic.

Figure 1:
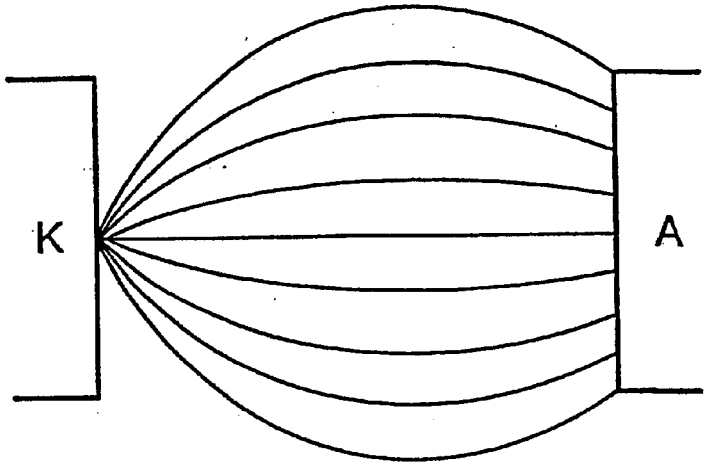
FIG. 1 shows a flickering discharge.
Figure 2:
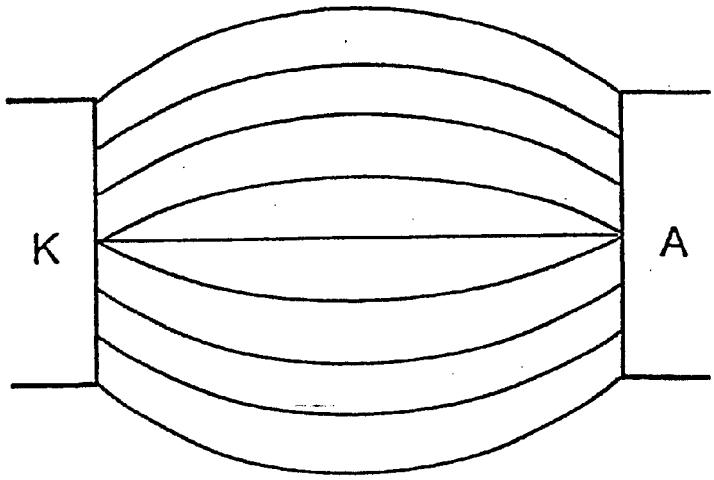
FIG. 2 shows a flicker-free discharge.
Figure 3:
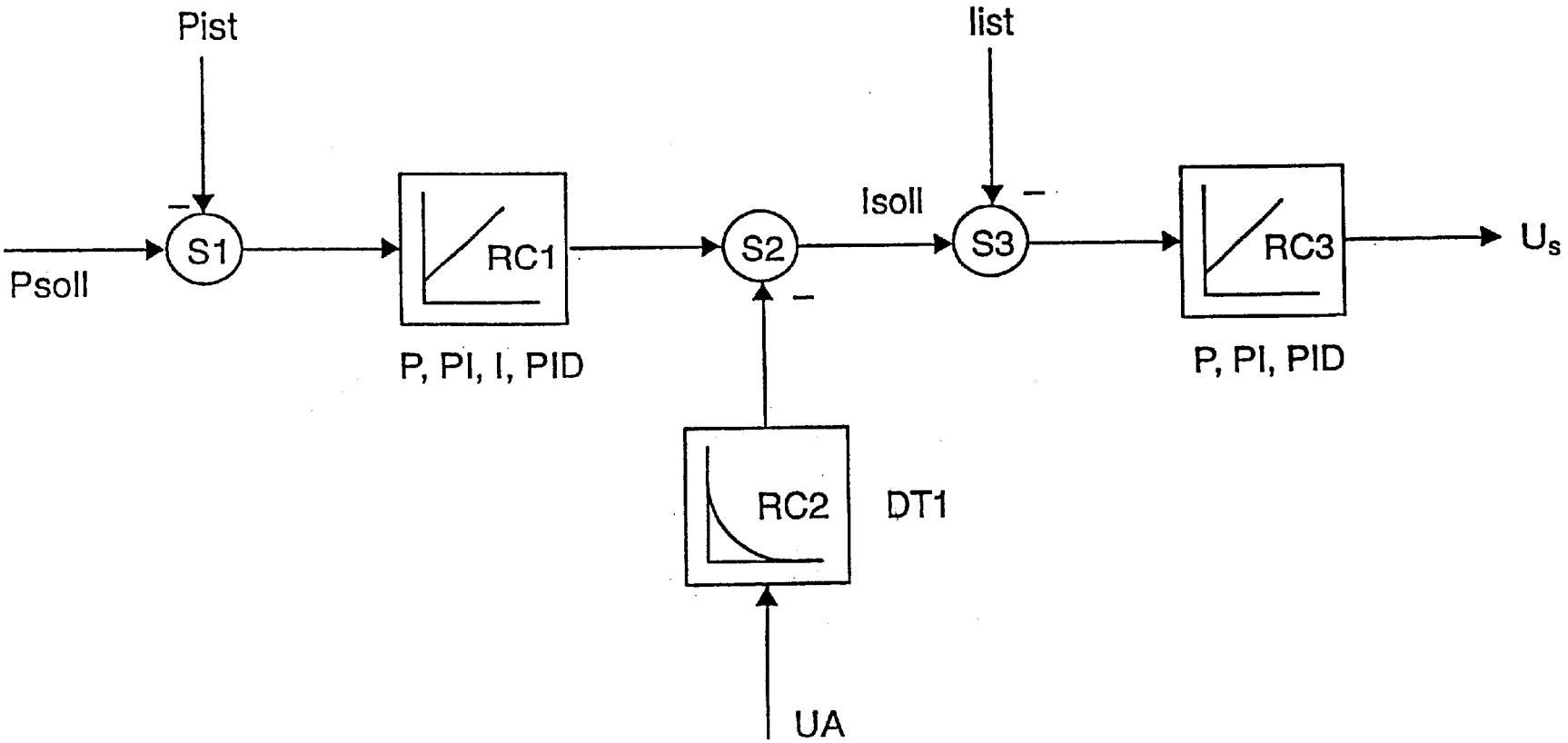
FIG. 3 shows a block diagram of the controller structure.
Figure 4:
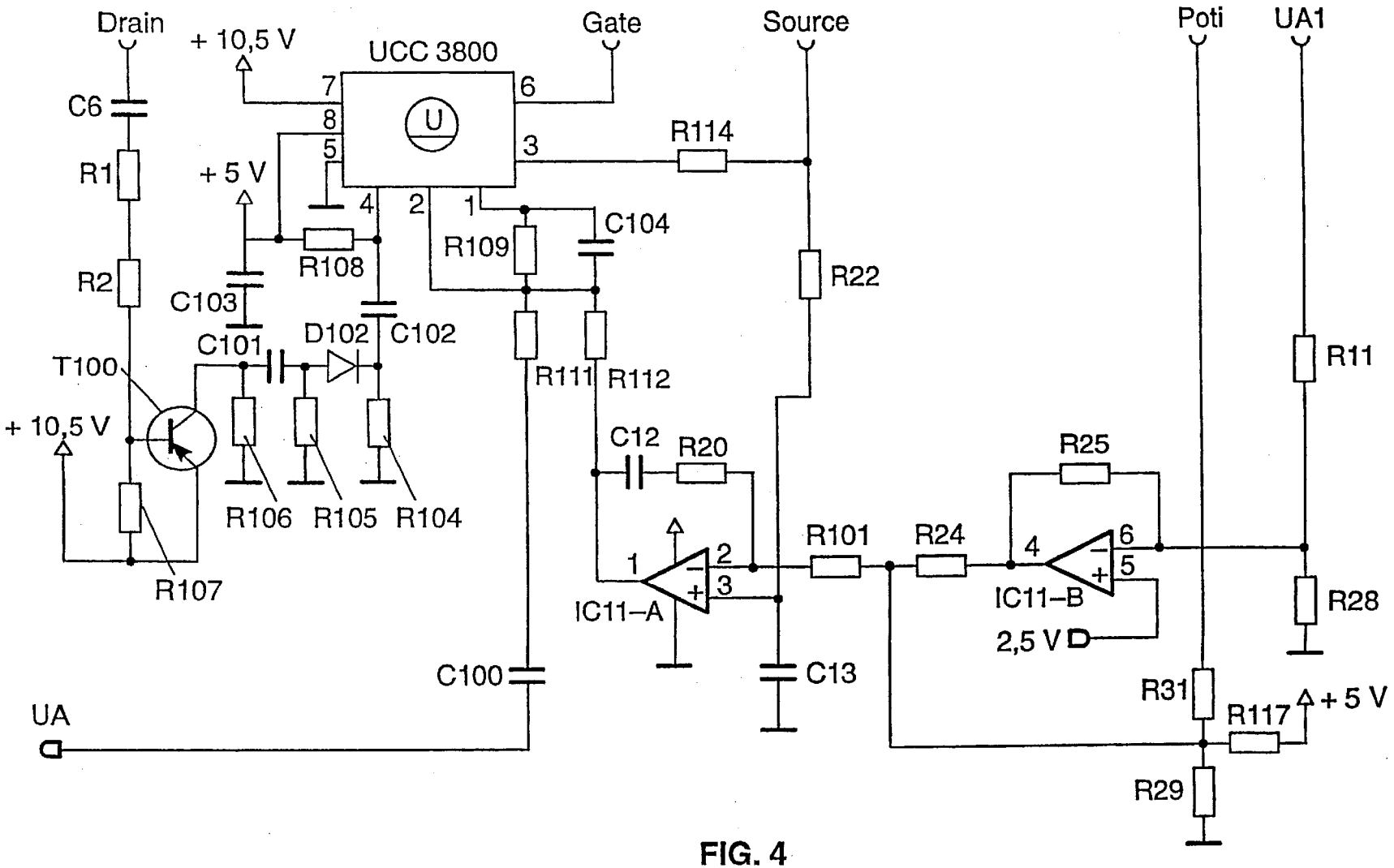
FIG. 4 shows a circuit diagram of a preferred exemplary embodiment.

FIG. 4 shows a circuit in which the rule structure illustrated in FIG. 3 is implemented. In what follows, components denoted by a R followed by a number are resistors, components which are denoted by a C followed by a number are capacitors, and components which are denoted by a T followed by a number are transistors. The central module is a Current Mode Controller UCC3800 available from the Unitrode company. This IC includes the first (S1) and the third (S3) subtraction points, possibilities for fixing the control characteristic RC3, and a circuit which generates the manipulated variable Us as a clock signal for driving the circuit breaker of the DC/DC converter mentioned in the descriptive section. This circuit breaker is typically a MOSFET whose time during which it is turned on is varied by a signal at the gate. This signal is available at the UCC3800 at pin 6 (OUT). An internal oscillator is required to generate the signal. The frequency of the oscillator can be set by R108 and C103 if it is running freely. In this case, the DC/DC converter operates in so-called Continuous Mode. R108 and C103 are connected in series. The tie point is connected to PIN 8 (REF) and a reference voltage of 5V. The other end of R108 is connected to PIN 4 (RC), while the other end of C103 is connected to frame.

Under specific operating conditions, which are not directly related to the invention, the DC/DC converter is put into the Discontinuous Mode by means of a circuit section which includes the components C6, R1, R2, R107, T100, R106, C101, R105, D102, R104 and C102. This circuit section is controlled by the voltage at the drain of the abovementioned MOSFET. The series circuit of C6, R1, R2 and R107 is situated between the drain and the operating voltage of 10.5V. The resistor R107 is simultaneously connected with one terminal to the operating voltage and the emitter of T100. The other terminal is connected to the base of T100. R106 and C101 are connected to the collector of T100. The other terminal of R106 is connected to frame, and the other terminal of C101 is connected to R105 and to the anode of D102. The other terminal of R105 is connected to frame, and the cathode of D102 is connected to R104 and C102. The other terminal of R104 is connected to frame, and the other terminal of C102 is connected to pin 4 (RC) of the UCC3800.

The UCC3800 is connected at pin 7 (VCC) and pin 5 (GND) to an operating voltage (10.5V) and frame. Psoll is fed in via pin 8 (REF); in this case, a reference voltage of 5V.

The provision of Pist is served by the circuit section which includes the components R11, R28, R29, R31, R117, R24, R25, IC11-B, R101 C13, C12, R20, R22 and IC11-A. IC11-A and IC11-B are operational amplifiers. At the output of IC11-A (pin1), the circuit section supplies a voltage which is proportional to the input power of the DC/DC converter. For this purpose, the intermediate circuit voltage U0 is fed via the terminal UA1 to an inverting amplifier which includes the components R11, R28, R25, R24 and IC11-B. R11 and R28 form a voltage divider between UA1 and frame. The signal at the connecting point of R11 and R28 is fed to the inverting input of IC11-B (pin6). The non-inverting input of IC11-B (pin5) is connected to a reference voltage of 2.5V. The feedback resistor R25 is situated between the output of IC11-B (pin4) and the inverting input of IC11-B. The output of IC11-B is connected to the inverting input of IC11-A (pin2) via the series circuit of R24 and R101.

The resistors R31, R29 and R117 are connected to the connecting point of R24 and R101. The other terminal of R29 is connected to frame, the other terminal of R117 is connected to the reference voltage of 5V, and the other terminal of R31 leads to the terminal Poti. A potentiometer can be connected to frame via the terminal Poti, and the lamp power can be set thereby.

The components R101, R22, C13, R20, C12 and IC1l-A form an adder in which the amplified voltage signal UA1 and the signal which is fed via the terminal Source and is a measure of the input current is added.

The signal from the terminal Source is fed to the non-inverting input of IC11-A (pin3) via R22. C13 is situated between the non-inverting input of IC11-A and frame. The series circuit of C12 and R20 is situated between the inverting input of IC11-A and the output of IC11-A.

The addition constitutes an approximation of the multiplication at the operating point, as a result of which there is present at pin 1 of IC11-A a signal whose voltage value is a measure of the input power of the DC/DC converter. With the aid of C12, the adder simultaneously generates the control characteristic RC1, in this case a PI characteristic. A weighted Pist signal is therefore available at pin 1 of IC11-A.

The input current, for which the signal fed via the terminal Source is a measure, is simultaneously a measure of the lamp current list given a constantly controlled input power and a constant intermediate circuit voltage U0. Consequently, in order to implement the inner control loop of the cascade control the signal of the terminal Source is fed via R114 to pin 3 (CS), and thus to the third subtraction point S3, which is integrated in the UCC3800.

The outer control loop of the cascade control is closed via R112, which connects the output of IC11-A and pin 2 (FB) of the UCC3800. Pin 2 (FB) of the UCC3800 simultaneously constitutes the signal Isoll and the second subtraction point S2. The output voltage UA of the DC/DC converter is present at the terminal UA. Via the series circuit of C100 and R111, it is fed to pin 2 (FB) of the UCC3800, and the feedforward control described is thereby implemented. C100 and R111 form the control characteristic RC2; in this case a DT1 characteristic.

The control characteristic RC3—in this case a PI characteristic—can be determined by the parallel-connected components C104 and R109, which are connected between pin 1 (COMP) and pin 2 (FB) of the UCC3800.

The pin designations of the UCC3800 specified in brackets relate to the data sheet of the manufacturer, UNITRODE, Merrimack, USA.

What is claimed is:

1. A method for operating at least one gas discharge lamp comprising the steps of:

providing a gas discharge lamp having electrodes, operating the gas discharge lamp in an AC mode wherein a gas discharge is established between the electrodes which alternate as an anode and a cathode during lamp operation, and providing control means for switching over polarity of lamp current before a focal point is formed on the cathode whereby flickering of the gas discharge lamp is reduced.

2. The method as claimed in claim 1, wherein the lamp has a rectangular lamp current.

3. The method as claimed in claim 1, wherein the lamp is a high-pressure or extra-high-pressure discharge lamp.

4. The method as claimed in claim 3, wherein the lamp is a short-arc lamp.

5. The method as claimed in claim 4, wherein the lamp has a rectangular lamp current with a frequency higher than 300 Hz.

6. A ballast for operating at least one gas discharge lamp comprising:

a device for providing a DC output voltage (UA), a device for providing an electrical quantity which is a measure of lamp power (Pist), a device for providing an electrical quantity which is a measure of a setpoint of the lamp power (Psoll), a device for providing an electrical quantity which is a measure of lamp current (Iist), and a device for controlling electrical quantities, wherein a controlling system fixes, as a function of the quantities Pist, Psoll and UA a quantity which is a measure of a setpoint of the lamp current (Isoll) and sets the lamp current by comparison with Iist.

7. The ballast as claimed in claim 6, wherein the quantities Pist and Psoll are evaluated using a proportional and/or integral and/or differential control characteristic.

8. The ballast as claimed in claim 6, wherein the quantity UA is evaluated using a proportional and/or integral and/or differential control characteristic.

9. The ballast as claimed in claim 6, wherein the quantities Iist and Isoll are evaluated using a proportional and/or integral and/or differential control characteristic.

* * * * *